US006312449B1

(12) United States Patent
Chang et al.

(10) Patent No.: US 6,312,449 B1
(45) Date of Patent: Nov. 6, 2001

(54) PACIFIER RETAINING DEVICE

(76) Inventors: Albert Chang; Doretta Chang, both of 239 Hawthorne St., Brooklyn, NY (US) 11225

( * ) Notice: Subject to any disclaimer, the term of this patent is extended or adjusted under 35 U.S.C. 154(b) by 0 days.

(21) Appl. No.: 09/494,168

(22) Filed: Jan. 31, 2000

(51) Int. Cl.[7] ..... A61T 17/00
(52) U.S. Cl. ..... 606/234
(58) Field of Search ..... 606/234, 235, 606/236; 24/302; D2/225, 226, 227–229; D24/44, 45, 46, 194, 3.13, 324, 662, 624, 595, 693, 618–619, 605, 901, 901.2; 2/240, 303, 306, 312, 314, 319, 333, 224

(56) References Cited

U.S. PATENT DOCUMENTS

D. 310,716 * 9/1990 Trask ..... D24/45
D. 325,470 4/1992 Harms .
736,788 * 8/1903 Schaffner .
1,873,763 * 8/1932 Braunkich .
2,986,396 * 5/1961 Abbott et al. ..... 273/55
3,392,729 * 7/1968 Lenoir ..... 128/360
4,765,037 8/1988 Perry .
4,825,516 * 5/1989 Ackermann et al. ..... 24/693
4,969,894 11/1990 Hempstead-Harris .
4,972,980 11/1990 Parsons .
4,985,968 * 1/1991 Hooper ..... 24/302
4,990,157 2/1991 Roberts et al. .
5,664,844 * 9/1997 Greene ..... 297/485

* cited by examiner

*Primary Examiner*—Gene Mancene
*Assistant Examiner*—Eduardo C. Robert

(57) ABSTRACT

A pacifier retaining device for holding a pacifier on a child so that the child does not lose the pacifier. The pacifier retaining device includes a first strap for encircling the torso of a user. A second strap connects a pacifier to the first strap. The second strap has a first end and a second end. A pacifier is coupled to the second strap. A connecting device rotatably connects the first strap to the second strap. The connecting device comprises a female portion and a male portion. The second end of the second strap is coupled to the male portion. The female portion is coupled to the first strap.

3 Claims, 2 Drawing Sheets

PACIFIER RETAINING DEVICE

BACKGROUND OF THE INVENTION

1. Field of the Invention

The present invention relates to retaining devices and more particularly pertains to a new pacifier retaining device for holding a pacifier on a child so that the child does not lose the pacifier.

2. Description of the Prior Art

The use of retaining devices is known in the prior art. More specifically, retaining devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,972.980; U.S. Pat. No. 3,392,729; U.S. Pat. No. 4,765,037; U.S. Pat. No. 4,990,157; U.S. Pat. No. 4,969,894; and U.S. Des. Pat. No. 325,470.

While these devices fulfill their respective, particular objectives and requirements, the aforementioned patents do not disclose a new pacifier retaining device. The inventive device includes a first strap for encircling the torso of a user. A second strap connects a pacifier to the first strap. The second strap has a first end and a second end. A pacifier is coupled to the second strap. A connecting means rotatably connects the first strap to the second strap. The connecting means comprises a female portion and a male portion. The second end of the second strap is coupled to the male portion. The female portion is coupled to the first strap.

In these respects, the pacifier retaining device according to the present invention substantially departs from the conventional concepts and designs of the prior art, and in so doing provides an apparatus primarily developed for the purpose of holding a pacifier on a child so that the child does not lose the pacifier.

SUMMARY OF THE INVENTION

In view of the foregoing disadvantages inherent in the known types of retaining devices now present in the prior art, the present invention provides a new pacifier retaining device construction wherein the same can be utilized for holding a pacifier on a child so that the child does not lose the pacifier.

The general purpose of the present invention, which will be described subsequently in greater detail, is to provide a new pacifier retaining device apparatus and method which has many of the advantages of the retaining devices mentioned heretofore and many novel features that result in a new pacifier retaining device which is not anticipated, rendered obvious, suggested, or even implied by any of the prior art retaining devices, either alone or in any combination thereof.

To attain this, the present invention generally comprises a first strap for encircling the torso of a user. A second strap connects a pacifier to the first strap. The second strap has a first end and a second end. A pacifier is coupled to the second strap. A connecting means rotatably connects the first strap to the second strap. The connecting means comprises a female portion and a male portion. The second end of the second strap is coupled to the male portion. The female portion is coupled to the first strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pacifier retaining device apparatus and method which has many of the advantages of the retaining devices mentioned heretofore and many novel features that result in a new pacifier retaining device which is not anticipated, rendered obvious, suggested, or even implied by any of the prior art retaining devices, either alone or in any combination thereof.

It is another object of the present invention to provide a new pacifier retaining device which may be easily and efficiently manufactured and marketed.

It is a further object of the present invention to provide a new pacifier retaining device which is of a durable and reliable construction.

An even further object of the present invention is to provide a new pacifier retaining device which is susceptible of a low cost of manufacture with regard to both materials and labor, and which accordingly is then susceptible of low prices of sale to the consuming public, thereby making such pacifier retaining device economically available to the buying public.

Still yet another object of the present invention is to provide a new pacifier retaining device which provides in the apparatuses and methods of the prior art some of the advantages thereof, while simultaneously overcoming some of the disadvantages normally associated therewith.

Still another object of the present invention is to provide a new pacifier retaining device for holding a pacifier on a child so that the child does not lose the pacifier.

Yet another object of the present invention is to provide a new pacifier retaining device which includes a first strap for encircling the torso of a user. A second strap connects a pacifier to the first strap. The second strap has a first end and a second end. A pacifier is coupled to the second strap. A connecting means rotatably connects the first strap to the second strap. The connecting means comprises a female portion and a male portion. The second end of the second strap is coupled to the male portion. The female portion is coupled to the first strap.

Still yet another object of the present invention is to provide a new pacifier retaining device that adjustable straps for use on infants of various sizes.

Even still another object of the present invention is to provide a new pacifier retaining device that has a rotatably coupling means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
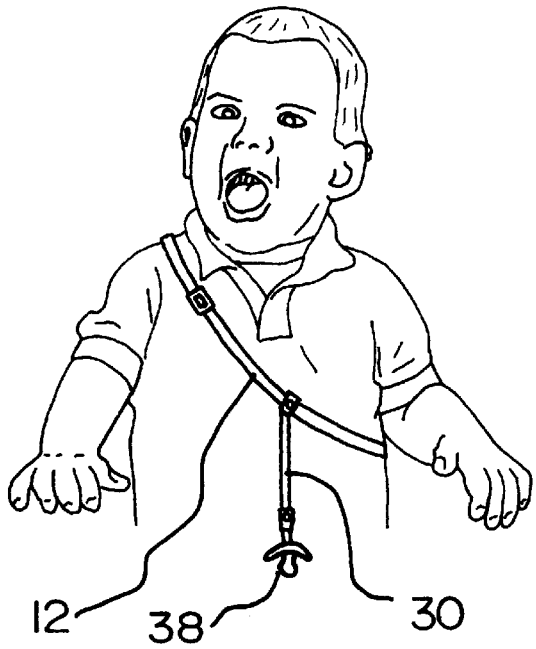
FIG. 1 is a schematic front view of a new pacifier retaining device according to the present invention.
Figure 2:
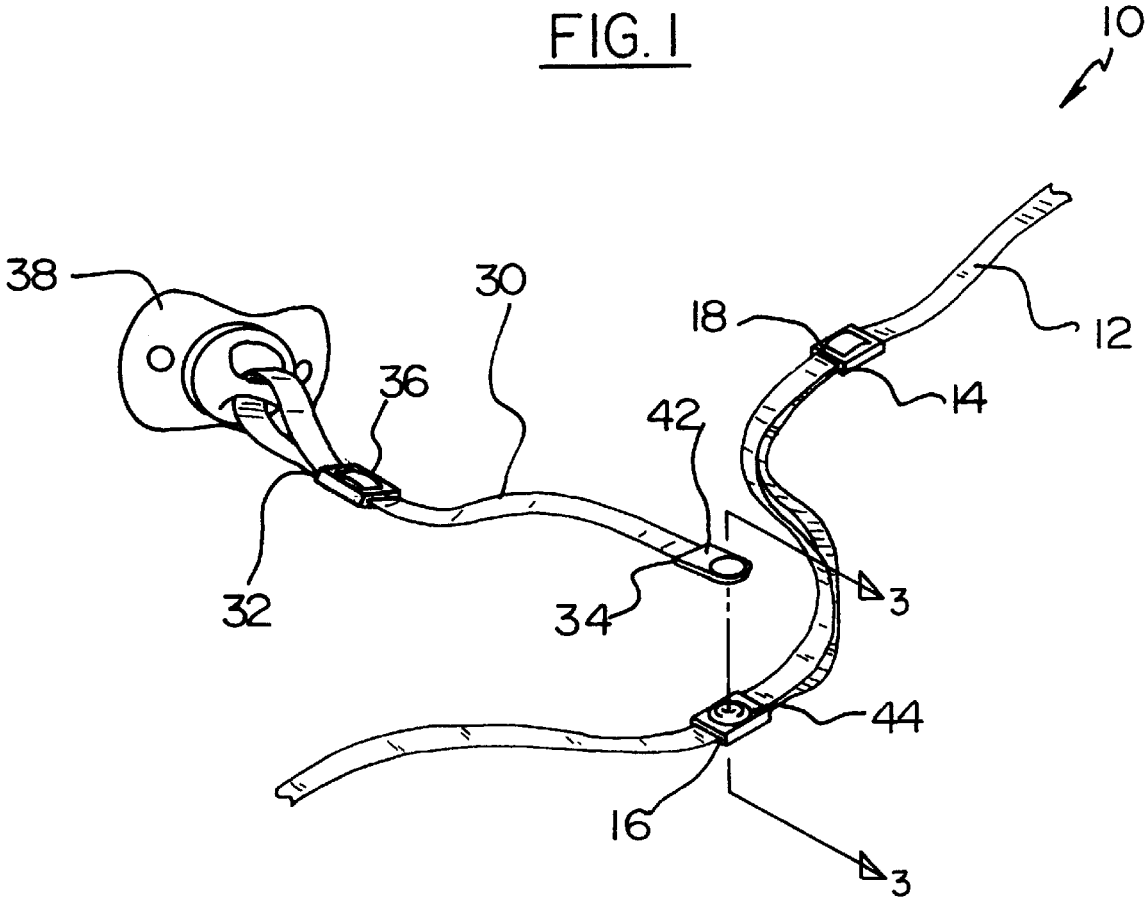
FIG. 2 is a schematic perspective view of the present invention.
Figure 3:
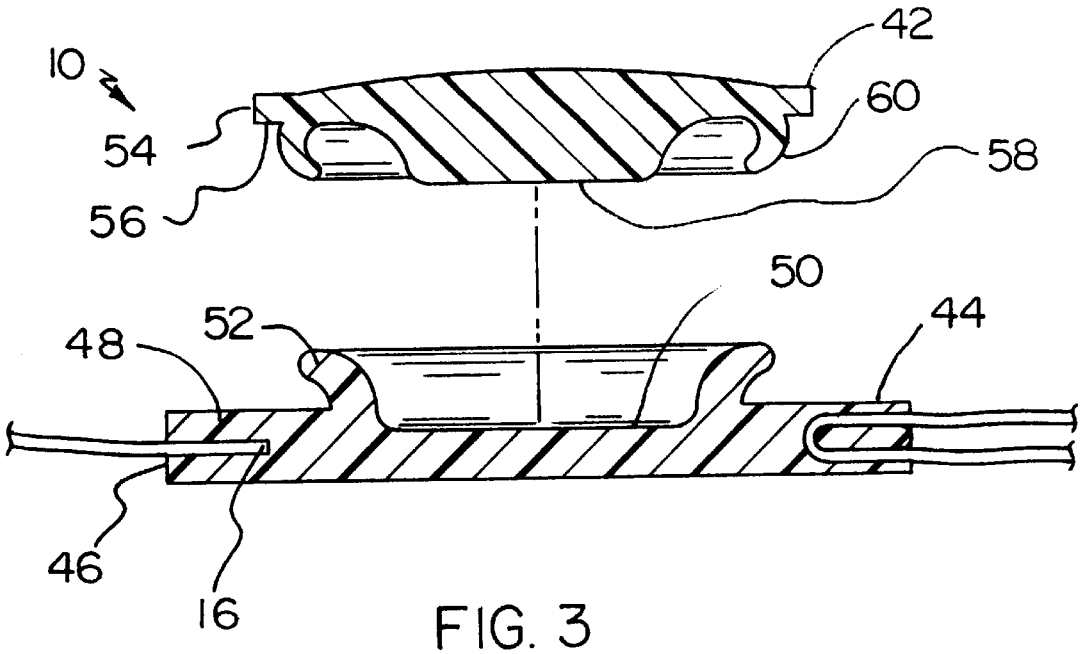
FIG. 3 is a schematic cross-sectional view of the coupling means of the present invention.
Figure 4:
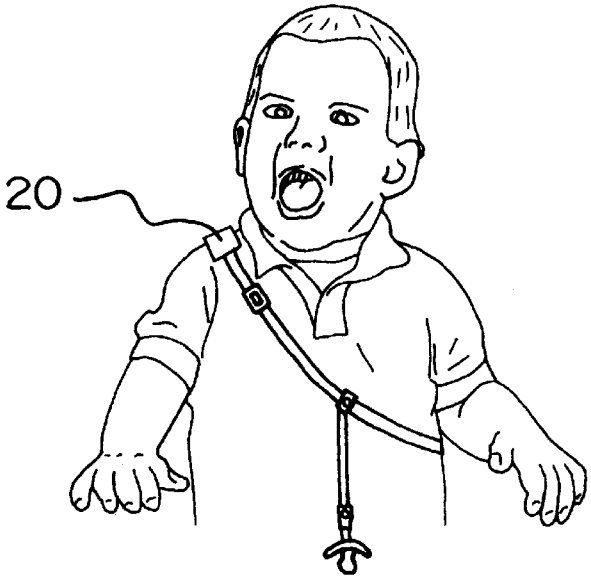
FIG. 4 is a schematic front view showing the pad of the present invention.

With reference now to the drawings, and in particular to FIGS. 1 through 4 thereof, a new pacifier retaining device embodying the principles and concepts of the present invention and generally designated by the reference numeral 10 will be described.

As best illustrated in FIGS. 1 through 4, the pacifier retaining device 10 generally comprises a first strap 12 for encircling the torso of a user, a second strap 30 for holding the pacifier, and a connecting 40 means for coupling the first strap to the second strap.

The first strap 12 has a first end 14 and a second end 16. A portion of the first strap is slidably coupled to the second end of the strap via the connecting means 40. The first end 14 has a first buckle 18 thereon adapted for connecting portions of the first strap 12 such that a loop with a variable circumference is created. The first strap has a pad 20 fixedly coupled thereto.

A second strap 30 connects a pacifier 38 to the first strap 12. The second strap 30 has a first end 32 and a second end 34. The first end 32 has a second buckle 36 thereon for forming a loop. The loop has a variable circumference.

A pacifier 38 is coupled by the loop in the second strap 30.

A connecting means 40 rotatably connects the first strap 12 to the second strap 30. The connecting means 40 comprises a male portion 42 and a female portion 44.

The female portion 44 is generally planer and has a peripheral edge 46. A portion of the first strap 12 is slidably connected to the female portion 44 and the second end 16 of the first strap 12 is fixedly coupled to the peripheral edge 46 of the female portion 44. The female portion 44 has a top surface 48 having a well 50 therein. An annular lip 52 extending away from the top surface 48 of the female portion 44 further defines the well 50. The lip 52 curves away from the well 50.

The male portion 42 is generally planar having a peripheral edge 54, and a bottom surface 56. The second end 34 of the second strap 30 is fixedly coupled to the peripheral edge 54 of the male portion 42. The bottom surface 56 has a protruding member 58 thereon. The protruding member 58 has a shape adapted to fit into the well 50. The male portion 42 has an annular lip 60 extending from the bottom surface 56 and about the protruding member 58. The annular lip 60 on the male portion 42 is curved toward the protruding member 58 such that annular lip 60 on the male portion 42 may be removably secured to the annular lip 52 on the female portion 44. Wherein the male portion 42 may rotate about the female portion 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pacifier retainer device, said device comprising:

a first strap for encircling the torso of a user, said first strap having a first end and a second end;

a second strap for connecting a pacifier to said first strap, said second strap having a first end and a second end;

a pacifier, said pacifier being coupled to said second strap;

a connecting means for rotatably connecting said first strap to said second strap, said connecting means comprising:

a first connector coupled to said second end of said second strap;

a second connector removably mountable to the first connector, the second connector being fixedly coupled to the second end of said first strap; and a slider member fixedly coupled to the first end of said first strap and being slidably mounted on a portion of said first strap between the first and second ends of said first strap;

wherein said second connector is fixedly mounted on the second end of said first strap and said second connector is slidably mounted on a portion of said first strap between said first end and said slider member to form a loop of variable circumference for selectively adjusting the position of said second connector on said first strap for positioning said second strap and said pacifier along said first strap.

2. The pacifier retainer device as in claim 1, wherein:

said second connector comprises a female portion being generally planer and having a peripheral edge, said female portion having a top surface having a well therein, said well being further defined by an annular lip extending away from top surface of said female portion, said lip curving away from said well; and said first connector comprises a male portion being generally planar, said male portion having a peripheral edge, and a bottom surface, said bottom surface having a protruding member thereon, said protruding member having a shape adapted to fit into said well, said male portion having an annular lip extending from said bottom surface and about said protruding member, said annular lip on said male portion being curved toward said protruding member such that annular lip on said male portion may be removably secured to said annular lip on said female portion, wherein said male portion may rotate about said female portion.

3. A pacifier retainer device, said device comprising:

a first strap for encircling the torso of a user, said first strap having a first end and a second end, a portion of said first strap being slidably coupled to said second end of said strap, said strap having a pad fixedly coupled thereto;

a second strap for connecting a pacifier to said first strap, said second strap having a first end and a second end;

a pacifier being coupled to said second strap;

a connecting means for rotatably connecting said first strap to said second strap, said connecting means comprising:

a first connector coupled to said second end of said second strap;

a second connector removably mountable to the first connector, the second connector being fixedly coupled to the second end of said first strap; and a slider member fixedly coupled to the first end of said first strap and being slidably mounted on a portion of said first strap between the first and second ends of said first strap;

wherein said second connector is fixedly mounted on the second end of said first strap and said second connector is slidably mounted on a portion of said first strap between said first end and said slider member to form a loop of variable circumference for selectively adjusting the position of said second connector on said first strap for positioning said second strap and said pacifier along said first strap;

wherein said second connector comprises a female portion being generally planer and having a peripheral edge, said female portion having a top surface having a well therein, said well being further defined by an annular lip extending away from top surface of said female portion, said lip curving away from said well; and wherein said first connector comprises a male portion being generally planar, said male portion having a peripheral edge, and a bottom surface, said bottom surface having a protruding member thereon, said protruding member having a shape adapted to fit into said well, said male portion having an annular lip extending from said bottom surface and about said protruding member, said annular lip on said male portion being curved toward said protruding member such that annular lip on said male portion may be removably secured to said annular lip on said female portion, wherein said male portion may rotate about said female portion.

* * * * *